United States Patent [19]

Aizawa

[11] Patent Number: 4,980,255

[45] Date of Patent: Dec. 25, 1990

[54] ELECTROPHOTOGRAPHIC PHOTORECEPTOR COMPOSITION

[75] Inventor: Kouichi Aizawa, Matsumoto, Japan

[73] Assignee: Fuji Electric Co., Ltd., Kawasaki, Japan

[21] Appl. No.: 332,561

[22] Filed: Mar. 31, 1989

[30] Foreign Application Priority Data

Apr. 1, 1988 [JP] Japan ..... 63-80938

[51] Int. Cl.[5] ..... G03G 15/04; G03G 15/00

[52] U.S. Cl. ..... 430/66; 430/56; 430/57

[58] Field of Search ..... 430/56, 66, 67

[56] References Cited

U.S. PATENT DOCUMENTS 3,915,703 10/1975 Yaskimori et al. ..... 430/56 X

FOREIGN PATENT DOCUMENTS 3541004 11/1985 Fed. Rep. of Germany .
0143347 7/1985 Japan ..... 430/56
2272281 11/1987 Japan ..... 430/66
3014153 1/1988 Japan ..... 430/66
3048565 3/1988 Japan ..... 430/66

OTHER PUBLICATIONS

Dialog World Patents Index, computer database abstract.

*Primary Examiner*—Marion C. McCamish
*Assistant Examiner*—S. Crossan
*Attorney, Agent, or Firm*—Brumbaugh, Graves, Donohue & Raymond

[57] ABSTRACT

An electrophotographic photoreceptor composition comprises in sequence:

(a) a conductive base layer;

(b) a carrier transport layer comprising an organic carrier transport material;

(c) a carrier generation layer comprising an organic carrier generation material; and (d) a surface protective layer characterized by having a transmissivity not exceeding 50% for light having a wavelength of 405 nm or less. The composition is advantageous in that it is capable of being employed in conjunction with a positive electrification method in electrophotographic image formation, and in that it exhibits enhanced resistance to fatigue from light exposure.

6 Claims, 3 Drawing Sheets

FIG. 2
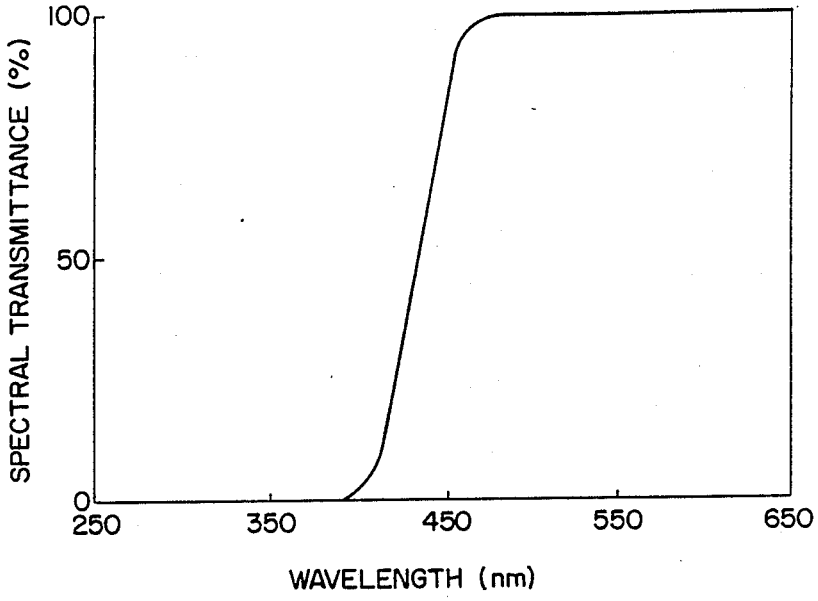
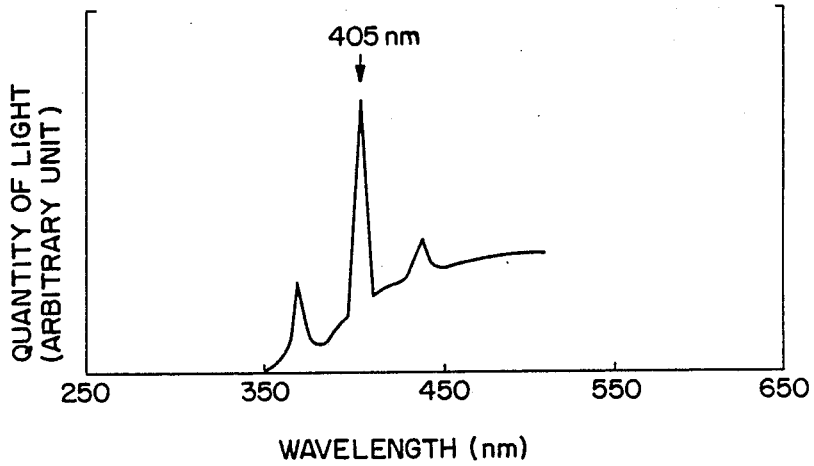
FIG. 3

ELECTROPHOTOGRAPHIC PHOTORECEPTOR COMPOSITION

BACKGROUND OF THE INVENTION

This invention relates to a photoreceptor composition useful in electrophotography. More particularly, this invention relates to a electrophotographic receptor composition comprising, in sequence, a conductive base layer, a carrier transport layer, a carrier generation layer, and a surface protective layer characterized by having a transmissivity not exceeding 50% for light having a wavelength of 405 nm or less.

In recent years, there has been extensive research on organic photoconductive substances as photosensitive materials for use as photoreceptors in electrophotography. A photosensitive material using an organic photoconductive material has many advantages in terms of properties such as flexibility, heat stability, film forming properties, transparency and cost. However, such materials have disadvantages in terms of darkness resistance and light sensitivity as compared with conventional photosensitive materials using an inorganic photoconductive substance such as selenium or the like. To overcome these disadvantages, photosensitive materials have been constructed using organic photoconductive substances which are formed by fabricating the photosensitive portion of the photoreceptor as a laminate of separate functional layers. The layers ordinarily comprise a layer contributing mainly to carrier generation, and a layer contributing mainly to retention of surface carriers in a dark place and to carrier transportation upon illumination of the photoreceptor. Such organic photoconductive substances are advantageous in that they are easy to form into a film. By selecting and using a material suitable to the respective function of each layer, overall electrophotographic characteristics of the photoreceptor may be improved.

This laminate-type photoreceptor is usually prepared by laminating a carrier generation layer containing an organic carrier generation material and a carrier transport layer containing an organic carrier transport material to a conductive base. Electrophotographic image formation using such a photoreceptor may be achieved, for example, using a Karlson method. Image formation according to this method is carried out by electrification of the photoreceptor by corona discharge applied to it in a dark place, formation of electrostatic latent images of letters, figures, and the like by exposing the surface of the photoreceptor to light, development of the electrostatic latent images formed with a toner, and transference and fixation of the developed toner image to a substrate such as paper or the like. After a toner image has been transferred, the photoreceptor is subjected to a process of removal of electrification, removal of residual toner, and removal of electrification by light before it is reused.

In the above-mentioned image formation method, a negative electrification method is typically employed to electrify the photoreceptor. This is disadvantageous because a significant amount of ozone is generated in a negative corona discharge, and the surface of the photoreceptor when electrified is strongly oxidized by ozone, causing deterioration of the photoreceptor itself or of other equipment. It would therefore be advantageous if a positive electrification method is employed in conjunction with a laminate-type photoreceptor, as the corona discharge is stable, and only a small amount of ozone is generated. In addition, a suitable developing agent is easy to produce in the case of positive electrification, as compared with the situation where negative electrification is employed. However, suitable organic carrier generation and transport materials necessary to produce a photoreceptor having the above-mentioned laminated functional layer design and to which a positive electrification method may be applied have not yet been found.

To make it possible to use a photoreceptor in conjunction with a positive electrification method, a method of formation of a single layer by mixing carrier generation and carrier transport materials, as well as a method of formation of a carrier generation layer on a carrier transport layer have been considered. However, it has been found that the former method has drawbacks such as low carrier-accepting capacity and lack of repeating characteristics. The latter method also is disadvantageous in that it is difficult to form a carrier generation layer of thickness not exceeding 1 micron, preferably not exceeding 0.3 micron, without changing the properties of the carrier transport layer.

In addition, in recent years it has become required that organic material-based photoreceptors exhibit durability equal to that of photoreceptors employing selenium. However, it has been found to be very difficult to satisfy such durability requirements with photoreceptor materials prepared by depositing a thin carrier generation layer onto a carrier transport layer. Several methods have been proposed to improve the durability of organic material-based photoreceptors by applying a surface protective layer having excellent abrasion resistance and light transmitting properties on a carrier generation layer. In particular, the use of tetraethyl silicate or a fluorine-containing comb-type polymer as the main component have been proposed.

However, in many cases, the surface protective layer is transparent in a region of all wavelengths of light, and transmits light of such a wavelength that even the carrier generation layer does not absorb it. If a photoreceptor with the above-mentioned surface protective layer is exposed to light of a fluorescent lamp for an extended period of time, the carrier generation material is fatigued by strong light of wavelength near 405 nm and the fatigued carrier generation material does not recover its characteristics unless allowed to stand in a dark place for several hours.

It is the object of this invention to provide an electrophotographic photoreceptor composition which comprises organic materials, may be used in conjunction with a positive electrification method, and which exhibits enhanced resistance to fatigue from exposure to light such as fluorescent light.

SUMMARY OF THE INVENTION

This invention is directed to an electrophotographic photoreceptor composition comprising in sequence:

(a) a conductive base layer;

(b) a carrier transport layer comprising an organic carrier transport material;

(c) a carrier generation layer comprising an organic carrier generation material; and (d) a surface protective layer characterized by having a transmissivity not exceeding 50% for light having a wavelength of 405 nm or less.

This invention is advantageous in that it may be used in electrophotographic image formation where positive electrification of the photoreceptor is employed, and it exhibits excellent abrasion resistance and enhanced resistance to fatigue from light exposure due to the characteristics of the surface protective layer.

BRIEF DESCRIPTION OF THE DRAWINGS

FIG. 2 is a graph showing the relationship of the spectral transmittance of the surface protective layer of this invention to the wavelength of incidental light.

FIG. 3 is a graph showing the relationship of the spectrum of light for ordinary fluorescent light.

DETAILED DESCRIPTION OF THE INVENTION

The invention will become apparent from the following detailed description together with specific references to the accompanying figures.

Figure 1:
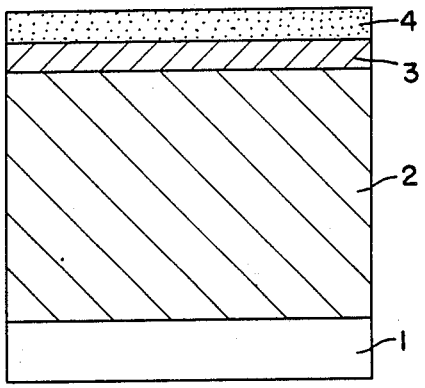
FIG. 1 is a cross-sectional view of the electrophotographic receptor composition of this invention.

FIG. 1 depicts a cross-sectional view of one embodiment of the electrophotographic receptor composition of this invention. In FIG. 1 conductive base 1 acts as an electrode for the photoreceptor, and concurrently provides a substrate for the other layers of the receptor. Conductive base 1 may be cylindrical, plate-shaped, or film-shaped, and it may be made from a material which may be a metal such as aluminum, stainless steel, nickel, or the like, or a glass material or a resin which has had its surface made conductive.

Carrier transport layer 2 is laminated onto conductive base 1. Carrier transport layer 2 is a coating film typically comprising an organic carrier transport material dispersed in a resin binder. It acts as an insulator layer by retaining carriers of the photoreceptor in a dark place and functions to transport carriers injected from carrier generation layer 3 when illuminated. As the organic carrier transport material, derivatives of pyrazoline, hydrazone, triphenylmethane, oxadiazole, and the like may be used. For example, 1-phenyl-3-(p-diethylaminostyryl)-5-(p-diethylaminophenyl)-2-pyrazoline (ASPP) is suitable for use. As the resin binder, polycarbonates, polyesters, polyamides, polyurethanes, epoxy resins, silicone resins, homopolymers and copolymers of methacrylic acid esters, and the like may be used. For example, polymethyl methacrylate polymer is suitable for use. In selecting a resin binder, not only its mechanical, chemical, and electrical stability and adhesion, but also its compatibility with a particular carrier transport material is of importance. The film thickness of carrier transport layer 2 depends upon the amount of carriers desired to be retained on the surface, but is typically 5–50 microns, preferably 10–25 microns.

Carrier generation layer 3 may be formed by the vapor deposition onto carrier transport layer 2 of organic photoconductive materials or by the application onto carrier transport layer 2 of a substance having particles of organic photoconductive materials dispersed in a resin binder. Phthalocyanine compounds and their derivatives such as metal-free phthalocyanines and titanyl phthalocyanines, various azo pigments, various quinone pigments, and various indigo pigments may be used as the organic carrier generation material. For example, copper phthalocyanine is suitable for use. Materials suitable for use as a resin binder in carrier generation layer 3 include those resins previously discussed in connection with carrier transport layer 2; for example, polyester resin is suitable for use.

Carrier generation layer 3 generates carriers when it is illuminated. It is important that carrier generation layer 3 have a high carrier generation efficiency and that generated carriers have suitable injectable properties into carrier transport layer 2 and surface protective layer 4. It is desirable that the injectable properties of generated carriers be minimally dependent upon electric field strength; that is, injectable properties should be good even in a low strength electric field.

A suitable carrier generation material may be selected according to the wavelength region of the exposure light source used for image formation. It is sufficient for carrier generation layer 3 to have a carrier generation function, and the film thickness of the layer depends upon the light absorption coefficient of the carrier generation material employed, although the thickness should not exceed 5 microns, and preferably does not exceed 1 micron. A carrier generation layer prepared by adding a carrier transport material or the like to a carrier generation material as the main component may also be employed.

The function of surface protective layer 4 is to receive and retain carriers of corona discharge in a dark place and also to transmit light which carrier generation layer 3 is sensitive to. It is necessary that surface protective layer 4 transmits light when exposed so that the light reaches carrier generation layer 3. Carriers generated in carrier generation layer 3 are then injected into surface protective layer 4 to neutralize carriers on the surface.

Surface protective layer 4 is formed by applying a coating solution of resin binder comprising additives which are added and mixed by a usual coating method known to those skilled in the art. An essential feature of surface protective layer 4 is that at least one additive must be a substance hindering the transmissivity of light of short wavelength, for example, pyrazoline or hydrazone or their derivatives. In this manner, surface protective layer 4 is characterized by having a transmissivity not exceeding 50% for light having a wavelength of 405 nm or less. The film thickness of surface protective layer 4 depends upon the particular formulation employed, but it can be set to an optional thickness to avoid a negative effect such as increased residual potential when a photoreceptor is used repeatedly. In general, the film thickness should be 10 microns or less, preferably 5 microns or less.

A photoreceptor lacking a surface protective layer such as surface protective layer 4 will have an insufficient carrier accepting capacity or have its carrier generation material properties altered by a corona discharge; furthermore, it will be unable to meet the requirements of sufficient photoreceptor durability as the photoreceptor is subjected to mechanical frictions such as cleaning and the like in an actual electrophotographic process.

The following examples illustrate preferred embodiments of this invention. It will be understood that the examples are merely illustrative, and not meant to limit the invention in any way.

EXAMPLE 1

A carrier transport layer was formed from a coating solution prepared by mixing a solution of 100 parts by weight of ASPP as an organic carrier transport material in 700 parts by weight of tetrahydrofuran (THF) with a solution of 100 parts by weight of polymethyl methacrylate polymer in 700 parts by weight of toluene. The coating solution was applied to an aluminum cylinder which acted as a conductive layer by a dipping method known to these skilled in the art so that a thickness of 15 microns of carrier transport layer was obtained after being dried.

A carrier generation layer was formed from a coating solution prepared by kneading a mixture of 50 parts by weight of copper phthalocyanine, 100 parts by weight of polyester resin, and a THF solvent in a mixer for 3 hours. The coating solution was applied to the above-mentioned carrier transport layer by a dipping method known to those skilled in the art so as to obtain a thickness of 1 micron of carrier generation layer after being dried.

Thereafter, a surface protective layer was formed from a coating solution prepared by formulating 6 parts by weight of tetraethyl silicate (ATRON NSi-300, a product of Toyo Soda Co.), 94 parts by weight of ethanol, 0.6 part by weight of ASPP and 12 parts by weight of toluene. The coating solution was applied to the above-mentioned carrier generation layer so as to obtain a thickness of 1.5 microns of surface protective layer after being dried. Thus, a Sample 1 of a photoreceptor composition of this invention was obtained. FIG. 2 represents the spectral transmittance curve of the surface protective layer of Sample 1. FIG. 3 represents a spectrum of light of a common fluorescent lamp. From FIG. 2 and FIG. 3, it may be understood that the spectrum of light of a fluorescent lamp has a peak value at 405 nm and that the above-mentioned surface protective layer filters light of wavelength of 405 nm or less in such a manner that the surface protective layer has a transmissivity not exceeding 50% for light having a wavelength of 405 nm or less.

A photoreceptor designated Sample 2 was prepared as a comparative example in a method whereby a carrier transport layer and a carrier generation layer were formed on a base layer under the same conditions as in the photoreceptor of Sample 1. Thereafter, a surface protective layer was formed using only tetraethyl silicate. The surface protective layer was transparent to light having wavelengths of 250 nm or greater.

Photoreceptors of Sample 1 and Sample 2 were allowed to stand for 10 minutes on a place located just below a fluorescent lamp and having an illuminance of about 1500 luxes. Thereafter, they were measured for electrical characteristics and evaluated for images obtained from them. The results are shown in Table 1.

TABLE 1

| Photoreceptor | Charge potential (V) Before irradiation | Charge potential (V) After irradiation | Image just after irradiation |
|---|---|---|---|
| Sample 1 | 601 | 602 | Good |
| Sample 2 | 600 | 298 | Bad |

As shown in Table 1, with a photoreceptor of the example of this invention (Sample 1) a difference in charge potential characteristics and a difference in image were not observed before and after irradiation. However, with a photoreceptor of the comparative example (Sample 2), charge potential was markedly lowered after irradiation and a bad image was formed. While not intending to be limited to any specific theory, the difference in charge potential and image exhibited by Sample 2 after irradiation can be rationalized as due to a charge caused by light of wavelength near 405 nm in bonds in the carrier generation layer of Sample 2.

EXAMPLE 2

Samples 3, 4, 5, 6, 7, and 8 comprising six types of photoreceptors were prepared by laminating a carrier transport layer and a carrier generation layer 3 on a conductive base layer under the same conditions as in Example 1 to prepare six photoreceptor intermediates and, thereafter, by applying a coating solution prepared by formulating 10 parts by weight of a fluorine-containing, comb-type polymer (LF-40, a product of Soken Kagaku Co.), 1 part by weight of 4-diethylaminobenzaldehyde diphenylhydrazone, and 50 parts by weight of methyl ethyl ketone to the carrier generation layer of each of the above-mentioned photoreceptor intermediates. The coating solution was applied in a manner such that the six photoreceptors were different from each other in terms of film thickness of corresponding surface protective layer, the thicknesses ranging from 0.1 micron to 5 microns. In Table 2, the relation between the film thickness of the surface protective layers and the transmissivity of light of wavelength of 405 nm is shown.

TABLE 2

| Sample | 3 | 4 | 5 | 6 | 7 | 8 |
|---|---|---|---|---|---|---|
| Thickness (μm) of surface protective layer | 0.1 | 0.2 | 0.5 | 1.0 | 2.0 | 5.0 |
| Transmissivity (%) of 405 nm wavelength light | 94 | 80 | 46 | 20 | 2 | 0 |

Figure 4:
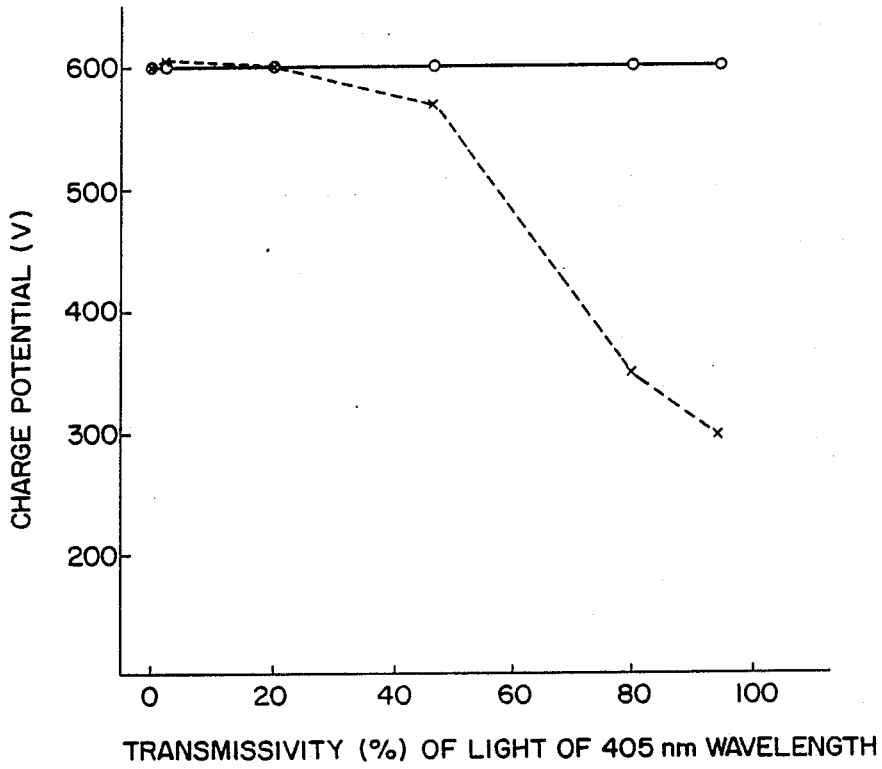
FIG. 4 is a graph showing the relationship of transmissivity of light of 405 nm wavelength to the charge potential of the receptor.

As in Example 1, these photoreceptors were allowed to stand just below a fluorescent lamp and thereafter were investigated for a change in charge potential due to irradiation. The results are shown in FIG. 4. The full line shows the charge potential for each of Samples 3–8 before irradiation and the broken line shows the charge potentials for each of Samples 3–8 after irradiation. From the result it is clear that, if the transmissivity of light of wavelength of 405 nm or less is 50% or less, the photoreceptor's resistance to fatigue from light is enhanced.

Although this invention has been illustrated by reference to specific embodiments, it will be apparent to those skilled in the art that various changes and modifications may be made which clearly fall within the scope of this invention.

I claim:

1. An electrophotographic photoreceptor composition comprising in sequence:

(a) a conductive base layer;

(b) a carrier transport layer comprising an organic carrier transport material;

(c) a carrier generation layer comprising an organic carrier generation material; and (d) a surface protective layer characterized by having a transmissivity not exceeding 50% for light having a wavelength of 405 nm or less.

2. A composition according to claim 1, in which the surface protective layer comprises a resin binder and an organic additive composition.

3. A composition according to claim 2, in which the organic additive composition is selected from the group consisting of hydrazone, and its derivatives.

4. A composition according to claim 1, in which the surface protective layer has a thickness of 10 microns or less.

5. A composition according to claim 4, in which the surface protective layer has a thickness of 5 microns or less.

6. A composition according to claim 2, in which the organic additive composition is selected from the group consisting of pyrazoline and its derivatives.

* * * * *